United States Patent [19]

Fogarty et al.

[11] 4,391,061

[45] Jul. 5, 1983

[54] MUSICAL TOY

[76] Inventors: A. Edward Fogarty; Bonnie R. Fogarty, both of 3513 School Ave., Sarasota, Fla. 33579

[21] Appl. No.: 333,580

[22] Filed: Dec. 22, 1981

[51] Int. Cl.[3] ..... A63H 29/16

[52] U.S. Cl. ..... 46/44; 46/177

[58] Field of Search ..... 46/44, 178, 118, 175 R, 46/177, 174; 84/330

[56] References Cited

U.S. PATENT DOCUMENTS

| | | | |
|---|---|---|---|
| 232,075 | 9/1880 | Secor | 46/179 X |
| 2,700,245 | 1/1955 | Kratt et al. | 46/44 X |
| 2,788,608 | 4/1957 | Anthony | 46/118 |
| 2,937,557 | 5/1960 | Hellman | 46/177 X |
| 3,093,925 | 6/1963 | Greene | 46/44 X |

*Primary Examiner*—Mickey Yu

*Attorney, Agent, or Firm*—Benjamin P. Reese, II

[57] ABSTRACT

A musical toy having audio-visual characteristics. A plurality of identical pneumatic systems, each for actuation of one of a plurality of vertically moveable ornaments, are positioned in the interior of a housing. Each of the pneumatic systems consists essentially of an air manifold in fluid communication with a bellows, a whistle and a vertical tube having a piston moveably positioned therein. Each of the bellows is operatively positioned in an access opening through the housing and the upper end of each of the vertical tubes extends out of an opening through the housing. Each of the pistons extends out of the upper end of its respective tube. One of the vertically moveable ornaments is affixed to the upper end of each of the pistons. When one of the bellows is compressed, air is simultaneously forced through the associated whistle to create a whistling sound and through the associated vertical tube to move the associated piston and vertically moveable ornament upward for their maximum distance of travel. When the bellows is released, the piston and ornament return to their at rest position. If the vertically moveable ornaments resemble the heads of birds, the simultaneous whistling sound and vertical movement creates an illusion of whistling birds.

3 Claims, 2 Drawing Figures

MUSICAL TOY

BACKGROUND OF THE INVENTION

This invention relates to a musical toy having audio-visual characteristics.

Musical toys for young children are well known in the art. Usually, such toys are essentially reduced size models of known musical instruments, such as pianos, clarinets, trumpets, drums and xylophones. Of course, the structures of such musical toys are substantially less complex than the structures of the corresponding musical instruments and are manufactured from materials which are substantially less expensive than those used for manufacture of the corresponding musical instruments.

Unless a child is skilled in playing the toy as a musical instrument, the primary appeal of most known musical toys is limited to the initial stimulation of the child's basic sense of hearing and sound which results from the child's first attempts to play the toy as a musical instrument. Unfortunately, most young children do not have well developed musical skills, and, therefore, are very limited in their abilities to play musical toys as musical instruments. Accordingly, most known musical toys have only limited play value after their initial period of use.

It is well known that most young children are intrigued by visual experiences. For this reason, a musical toy which creates a simultaneous visual effect would have substantially greater play value for sustained time periods than is the case with most known musical toys. Such a musical toy would be particularly suitable for use by young children who do not have well developed musical skills. And, of course, such a musical toy should be both inexpensive to manufacture and safe and easy for use by young children.

SUMMARY OF THE INVENTION

The present invention provides a musical toy having audio-visual characteristics. When the preferred embodiment of the musical toy of the present invention is operated, the resulting audio-visual effect, namely, the illusion of whistling birds, is intriguing to many young children. The musical toy of the present invention is both inexpensive to manufacture and safe and easy for use by young children.

The exterior of the musical toy of the present invention comprises a housing, a plurality of parallel bellows, and a plurality of parallel, vertically moveable ornaments. A plurality of identical pneumatic systems, each for actuation of one of the vertically moveable ornaments, are positioned in the interior of the housing. Each of the bellows is operatively positioned in an opening through a lower platform of the housing with its open end fitted over the inlet port of the air manifold of one of the pneumatic systems.

The air manifold of each of the pneumatic systems is essentially E-shaped with a first outlet port and a second outlet port in addition to its inlet port. Each of the air manifolds has a conventional whistle fitted over its first outlet port and an elongated tube fitted over its second outlet port. The various whistles have different musical characteristics to provide a range of musical sounds for the musical toy. The upper end of each of the elongated tubes extends out of an opening through an upper platform of the housing.

An elongated piston is moveably positioned in each of the elongated tubes by suitable centering means. Each of the pistons has a flexible, cup-shaped seal on its lower end. The upper end of each of the pistons extends out of the upper end of its respective tube and has one of the vertically moveable ornaments attached thereon. A stop is provided at the upper end of each of the tubes to limit the upward travel of the respective piston and vertically moveable ornament.

When one of the bellows is compressed, air in its associated air manifold is simultaneously forced through the first outlet port into its associated whistle and through the second outlet port into its associated elongated tube. A whistling sound is created as the air passes through the whistle and discharges to the atmosphere. The piston in the elongated tube, and its associated vertically moveable ornament, move upward for their maximum distance of vertical travel. When the bellows is released, the piston and ornament return to their at rest position.

These and many other features and objects of the present invention will be apparent from the following Brief Description of Drawings, Detailed Description of the Preferred Embodiment, and Claims, and the accompanying drawing.

DETAILED DESCRIPTION OF THE PREFERRED EMBODIMENT

Figures 1, 2:
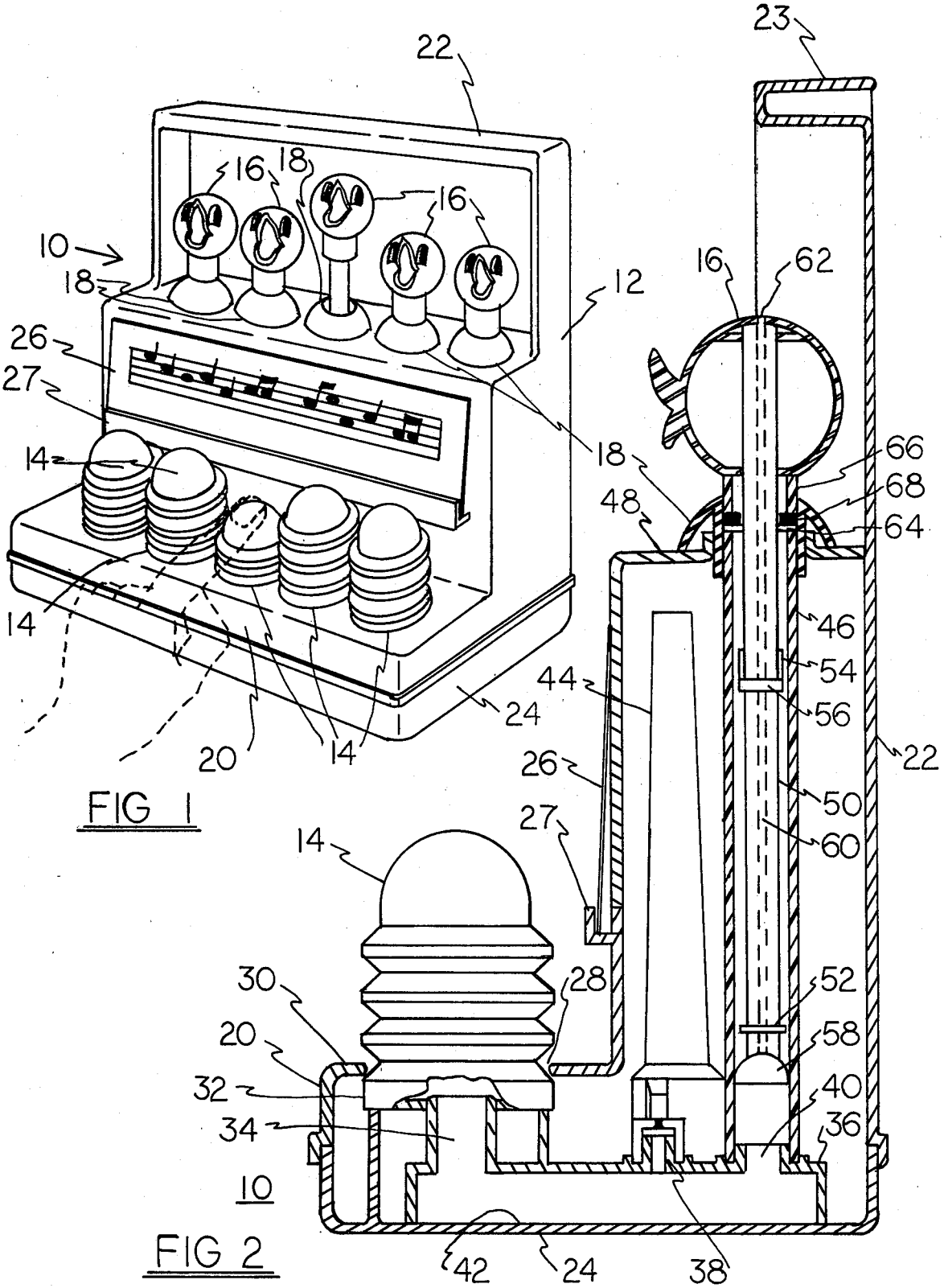
FIG. 1 is a perspective view of one embodiment of the musical toy of the present invention.
FIG. 2 is a side view in partial cross section illustrating a typical pneumatic system and associated elements.

The preferred embodiment of the musical toy of the present invention is illustrated in FIGS. 1 and 2.

Referring to FIGS. 1 and 2, the musical toy which is illustrated is designated generally by the reference numeral 10. In essence, the exterior configuration of the musical toy 10 is defined by a rigid housing 12, a plurality of parallel bellows 14, and a plurality of parallel, vertically moveable ornaments 16. A plurality of identical pneumatic systems, each for actuation of one of the vertically moveable ornaments 16, are positioned in the interior of the housing 12. Each of the bellows 14 functions as a fluid pump for one of the pneumatic systems.

Each of the ornaments 16 is preferably an essentially hollow, molded plastic body having a geometrical shape or surface ornamentation, or both, which gives it the appearance of an animal or human head. When ornaments 16 having the appearance of animal or human heads are used with the musical toy 10, it is desirable to provide a plurality of stationary ornamental elements 18, each of which resembles the upper portion of the body of the particular animal or human form selected for the corresponding moveable ornament 16, to complement the appearance of the moveable ornaments 16. Vertically moveable ornaments 16 and stationary ornamental elements 18 which respectively resemble the heads and bodies of birds are believed to be particularly suitable for use with the musical toy 10 because of its inherent musical characteristics and features.

The housing 12 illustrated in FIGS. 1 and 2 consists essentially of three components, namely, a front cover 20, a rear cover 22 and a bottom plate 24. The number and configuration of these components was selected for convenience in molding the housing 12 from suitable plastic materials in the conventional manner. If it is desirable to fabricate the housing 12 from other suitable materials, the specific number and configuration of the individual components of the housing 12 can be varied to accomodate the fabrication process which is selected. While it is not essential for operation of the musical toy 10, it is desirable to provide a means for supporting small sheets of musical paper 26 on the housing 12. An elongated, upwardly open U-shaped channel 27 on the face of the front cover 20 has proved to be particularly suitable for this purpose. It is also desirable that the rear cover 22 extend upward to a height above the maximum height of the vertically moveable ornaments 16 and terminate in a horizontal projection 23 over the ornaments 16 to shield the ornaments 16 from physical damage.

The interior configuration and operation of the musical toy 10 can be understood most easily by reference to the cross-sectional view in FIG. 2 which illustrates one of a plurality of identical pneumatic systems, each for actuation of one of the vertically moveable ornaments 16. A bellows 14 is shown operatively positioned in a cylindrical opening 28 through the lower platform 30 of the front cover 20. The open end 32 of the bellows 14 is fitted over the inlet port 34 of an essentially E-shaped air manifold 36 having a first outlet port 38 and a second outlet port 40 such that the bellows 14 and air manifold 36 are coupled for fluid communication. The air manifold 36 illustrated in FIG. 2 is molded from a suitable plastic material in the conventional manner and cemented to the interior surface 42 of the bottom cover 24 to form an air tight passageway. Of course, the air manifold 36 could be fabricated by other suitable fabrication processes and from other suitable materials.

The air manifold 36 has a conventional whistle 44 fitted over its first outlet port 38 such that the air manifold 36 and the whistle 44 are coupled for fluid communication. The diameter of the first outlet port 38 and the length, diameter and other structural characteristics of the whistle 44 determine the pitch, tone and other musical characteristics of the whistle 44 in the conventional manner. Each of the air manifolds 36 is in fluid communication with a whistle 44 having musical characteristics different from the other whistles 44. An open-ended, elongated tube 46 is fitted over the second outlet port 40 of the air manifold 36 such that the air manifold 36 and the tube 46 are coupled for fluid communication. The tube 46 extends upward in the interior of the housing 12 and terminates in the interior of the stationary ornamental element 18 at a point above the plane of the upper platform 48 of the front cover 20. As illustrated in FIG. 2, the ornamental element 18 is fixedly positioned in a cylindrical opening through the upper platform 48 of the front cover 20.

A light weight, elongated piston 50 is moveably positioned in the center of the tube 46 by suitable centering means, such as a lower flange 52 and a centering ring 54 which rests on an upper flange 56. A cup-shaped seal 58 formed from a suitable flexible material, such as soft rubber, is attached to the lower end of the piston 50. The piston 50 extends upward through the open end of the tube 46 and the interior of the stationary ornamental element 18 and terminates in the interior of the vertically moveable ornament 16 such that the ornament 16 is attached thereon. While it is not essential for operation of the musical toy 10, it is desirable to provide a relatively small diameter, longitudinal bore 60 along the central axis of the piston 50. The lower end of the bore 60 is open to that portion of the interior of the tube located below the cup-shaped seal 58 by means of a relatively small, concentric opening through the wall of the seal 58 and the upper end of the bore 60 is open to the outside atmosphere by means of a relatively small, concentric orifice 62 through the wall of the vertically moveable ornament 16. Finally, a washer 64 or other suitable stop is provided at the upper end of the tube 46 to engage the centering ring 54 when the piston 50 moves upward in the tube 46, and, thereby, limit the upward movement of the vertically moveable ornament 16.

It should be apparent from the foregoing structural description that the musical toy 10 has exceedingly simple and reliable operating characteristics. One merely selects a bellows 14 and presses it downward in the manner illustrated in FIG. 1. As the bellows 14 is compressed, air in its associated air manifold 36 is simultaneously forced through the first outlet port 38 into the whistle 44 and through the second outlet port 40 into the tube 46. The air passing through the whistle 44 creates a whistling sound in the conventional manner as it is discharged to the atmosphere. Simultaneously, the mainstream of the air in the tube 46 acts on the lower side of the cup-shaped seal 58 to move the piston 50 and vertically moveable ornament 16 upward until the centering ring 54 on the piston 50 engages the washer 64 at the upper end of the tube 46. A secondary stream of air in the tube 46 travels upward through the open bore 60 of the piston 50 and discharges to the atmosphere to damp the starting motion of the piston 50 and correct off center motion of the piston 50 for smoother operation of the piston 50 and vertically moveable ornament 16. When the bellows 14 is released, the piston 50 and vertically moveable ornament 16 move downward until the neck or lower portion 66 of the ornament 16 engages the upper surface of the interior flange 68 of the stationary ornamental element 18.

While the present invention has been disclosed in connection with its preferred embodiment, it should be understood that there may be other embodiments which fall within the scope and spirit of the invention as defined by the claims.

We claim:

1. A musical toy, comprising:

(a) a housing;

(b) a plurality of air manifolds positioned in the interior of said housing, each of said air manifolds having an inlet port, a first outlet port and a second outlet port;

(c) a plurality of bellows operatively positioned in openings through said housing, each of said bellows having its open end in fluid communication with said inlet port of one of said air manifolds;

(d) a plurality of whistles positioned in the interior of said housing, each of said whistles having one of its ends in fluid communication with said first outlet port of one of said air manifolds;

(e) a plurality of tubes positioned essentially vertically in the interior of said housing, each of said tubes having its lower end in fluid communication with said second outlet port of one of said air manifolds and its upper end extending out of an opening through said housing;

(f) a plurality of pistons moveably positioned in said tubes, each of said pistons having a flexible seal on its lower end, a lower flange, an upper flange, a centering ring resting on said upper flange and its upper end extending out of said upper end of one of said tubes;

(g) means for limiting the distance of travel of said pistons; and (h) a plurality of moveable ornaments exterior to said housing, each of said moveable ornaments being connected to one of said pistons.

2. A musical toy as recited in claim 1, wherein said means for limiting the distance of travel of said pistons comprises a stop at said upper end of each of said tubes to engage said centering ring on said piston moveably positioned therein.

3. A musical toy as recited in claim 2, wherein each of said pistons has an open bore along its central axis.

* * * * *